United States Patent [19]

Passera, deceased et al.

[11] 3,993,032

[45] Nov. 23, 1976

[54] FUEL INJECTION SYSTEMS

[75] Inventors: Walter Passera, deceased, late of Stuttgart, Germany, by Ludwig Passera, heir; Konrad Eckert, Stuttgart; Wolf Wessel, Schwieberdingen, both of Germany

[73] Assignee: Robert Bosch G.m.b.H., Stuttgart, Germany

[22] Filed: May 13, 1975

[21] Appl. No.: 577,119

[30] Foreign Application Priority Data

May 13, 1974 Germany ..... 2324110

[52] U.S. Cl. ..... 123/139 AW; 123/140 MC

[51] Int. Cl.[2] ..... F02M 69/00

[58] Field of Search. 123/119 R, 139 AW, 140 MC; 60/285, 276

[56] References Cited

UNITED STATES PATENTS 3,680,535 8/1972 Eckert et al. ..... 123/119 R 3,703,888 11/1972 Eckert et al. ..... 123/119 R 3,842,813 10/1974 Eckert..... 123/119 R

*Primary Examiner*—Charles J. Myhre

*Assistant Examiner*—Tony M. Argenbright

*Attorney, Agent, or Firm*—Edwin E. Greigg

[57] ABSTRACT

In a fuel injection system for an internal combustion engine, a fuel metering valve is controlled by an air sensing element disposed in the air intake tube for metering fuel quantities proportionate to the intake air quantities, and by an electromagnetic valve and an associated control structure which varies the air-fuel ratio by changing the pressure difference across the fuel metering valve, as a function of engine temperature during warmup, then as a function of, for example, the oxygen content in the engine exhaust gases.

11 Claims, 3 Drawing Figures

FUEL INJECTION SYSTEMS

BACKGROUND OF THE INVENTION

The present invention relates to a fuel injection system for a spark plug-ignited internal combustion engine that operates on fuel continuously injected into the suction pipe (air intake pipe), in which an air sensor and an arbitrarily operable butterfly valve are disposed in series. The air sensor is displaced against a return force in proportion to the quantity of air flowing through the suction pipe. In the course of its excursion, the air sensor displaces a control plunger part of a fuel metering valve disposed in the fuel supply line, which meters a fuel quantity which is proportionate to the quantity of throughgoing air. The afore-noted return force is provided by a liquid which is continuously delivered under constant but arbitrarily variable pressure through a control pressure line and which exerts the return force on the control plunger. The pressure of the liquid is variable by at least one pressure control valve controllable as a function of the engine characteristics. The pressure control valve is in the form of a flat seat valve having a diaphragm as its movable valve part.

This type of fuel injection system is designed to automatically provide a good fuel-air mixture for all the operating conditions of the internal combustion engine so as to obtain complete combustion of the fuel and thus, with the least possible fuel consumption, to prevent the production of toxic exhaust gases, or at least to considerably reduce the same. The quantity of fuel must therefore be very accurately metered in accordance with the requirements of each operating state of the internal combustion engine and the air to fuel ratio must be varied as a function of operating parameters such as speed, load, temperature and exhaust gas composition.

In the case of known fuel injection systems of this type, the quantity of fuel which is metered out is, as far as possible, proportionate to the quantity of air flowing through the suction pipe. The ratio of the quantity of fuel metered to the quantity of air may be varied by changing the return force of the metering element as a function of the operaing parameters of the internal combustion engine by means of an electromagnetic pressure control valve.

OBJECT AND SUMMARY OF THE INVENTION

A principal object of the present invention is to provide a fuel injection system of the type mentioned initially wherein, with the least possible expenditure, the return force on the metering element may be varied as a function of the operating parameters of the internal combustion engine.

According to the present invention this object and others are achieved by actuating the electromagnetic valve during the warm-up stage of the engine by a voltage supplied by a temperature gauging transmitter via an electronic control device and, upon termination of the warm-up stage, by a voltage supplied by an exhaust gas measuring probe determining the oxygen content in the exhaust gas of the internal combustion engine, or alternatively, by a voltage proportional to another operating parameter.

According to an advantageous feature of the present invention, the electromagnetic valve is controllable with a constant open time and a variable frequency of opening.

According to another advantageous feature of the present invention, the electromagnetic valve can be controlled by the ignition pulses to have a frequency of opening directly proportional to engine speed, and with a variable open time.

Another advantageous feature of the present invention is that the electromagnetic valve is in the form of a flat seat valve with a diaphragm as the movable valve part, which acts as an armature to open the electromagnetic valve when energized. When de-energized, the valve is closed by a counterspring acting on the diaphragm. The upper limit of the control pressure in the control pressure line is determined by the pressure in the system and the lower limit by the force of the counterspring.

In a preferred embodiment of the invention, a throttle (butterfly valve) is disposed in the pressure control line downstream of the electromagnetic valve, so that the upper limit of the control pressure is determined by the pressure in the system and the lower limit by the throttle.

In another embodiment of the invention, the electromagnetic valve is adapted to be mounted on the metering and distributor housing in the manner of prefabricated machine parts.

Other objects, features and advantages of the present invention will be made apparent in the course of the following detailed description of a preferred embodiment thereof provided with reference to the accompanying drawings.

DESCRIPTION OF THE PREFERRED EMBODIMENT

Figure 1:
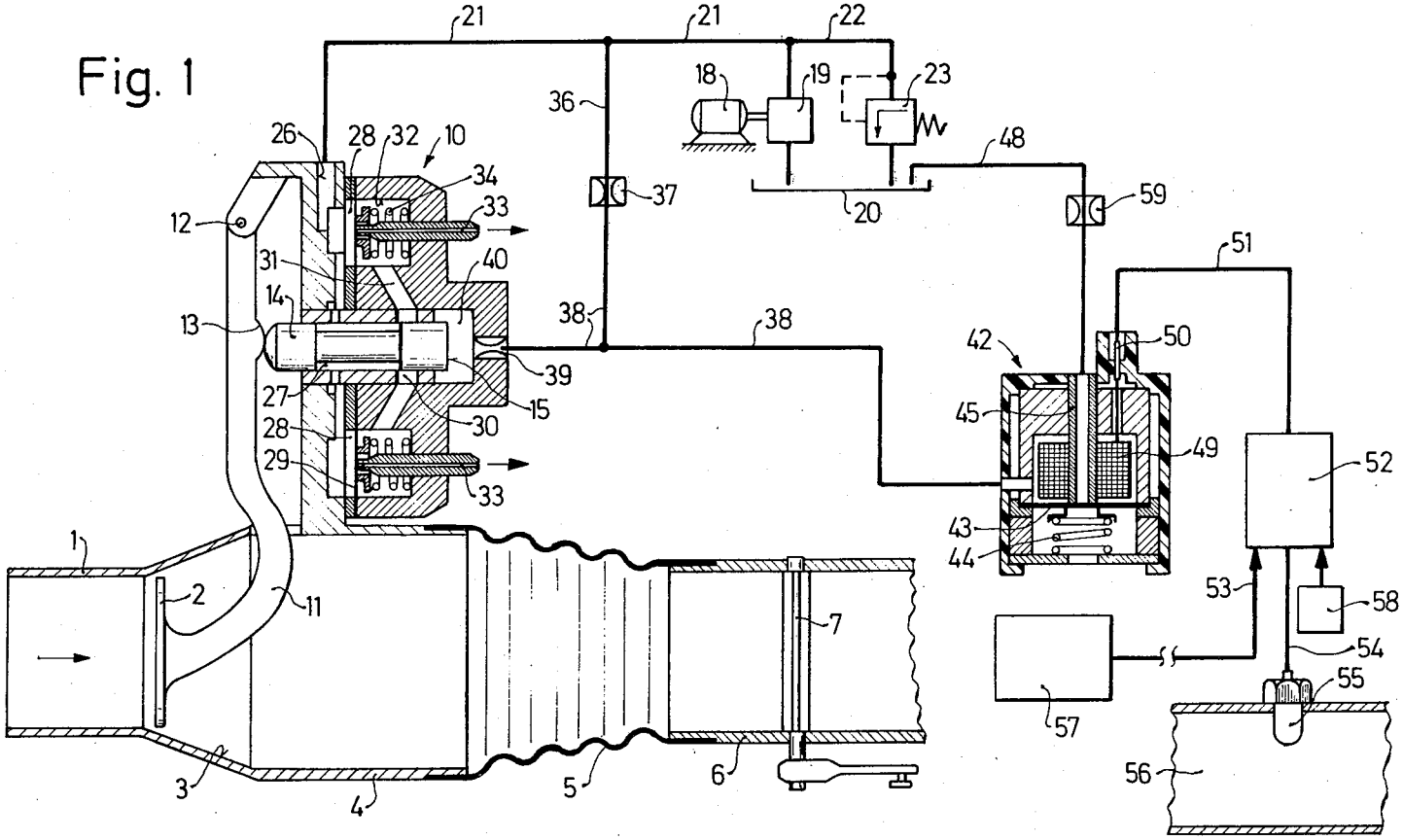
FIG. 1 schematically illustrates a fuel injection system according to the present invention.

In the fuel injection system shown in FIG. 1 the combustion air flows in the direction of the arrow through a suction pipe section 1, in which an air sensor or air measuring element 2 is disposed in a conical portion 3, and then through a suction pipe portion 4 and a coupling hose 5 into a suction pipe portion 6 in which there is disposed an arbitrarily operable butterfly valve 7. From the latter the combustion air flows to one or more cylinders (not shown) of an internal combustion engine. The air sensor 2 comprises a plate disposed at right angles to the direction of flow, which is displaced in the conical suction pipe portion 3 as an approximately linear function of the quantity of air flowing through the suction pipe. Given a constant return force exerted on the air sensor 2 and the constant air pressure prevailing upstream of the air sensor 2, the pressure prevailing between the air sensor 2 and the butterfly valve 7 also remains constant.

The air sensor 2 directly controls a metering and fuel distributor valve 10. For the transmission of the motion of the air sensor 2 there is provided a lever 11 which is connected to the air sensor 2 and which is pivotably mounted by a pivot pin 12. The lever 11 is provided with a nose 13 which actuates the control plunger 14 forming the movable valve member of the metering and fuel distributor valve 10 during its pivoting motion. The front face 15 of the control plunger 14, disposed remote from the nose 13, is exposed to the force of a pressurized fluid, the pressure of which serves as the return force exerted on the air sensor 2.

Fuel is supplied by a fuel pump 19 driven by an electric motor 18. The fuel pump 19 draws fuel from a fuel tank 20 and delivers it through a conduit 21 to the fuel metering and distributor valve 10. A conduit 22 connects conduit 21 to a pressure limiting valve 23, which allows fuel to flow back into the fuel tank 20 when there is excessive pressure in the system.

From the conduit 21 the fuel is admitted into a channel 26 provided in the housing of the fuel metering and distributor valve 10. The channel 26 leads to an annular groove 27 of the control plunger 14 and further leads through several branch conduits to chambers 28; thus, the one side of a diaphragm 29 is exposed to the fuel pressure. Depending uon the axial position of the control plunger 14, the annular groove 27 overlaps to a greater or lesser extent the control slots 30, each of which leads to a separate chamber 32 through a separate associated channel 31. Each chamber 32 is separated from an associated separate chamber 28 by the diaphragm 29. From the chambers 32 the fuel is admitted through injection channels 33 to the individual fuel injection valves (not shown) which are positioned in the suction pipe in the vicinity of the associated engine cylinder. Each diaphragm 29 serves as the movable member of a flat seat valve which, when the fuel injection system is inoperative, is maintained open by a spring 34. These flat seat valves serve as second differential pressure valves which operate to maintain a substantially constant pressure drop across the fuel metering valve members 27, 30, independently from the quantities of fuel flowing from the annular groove 27 into the control slots 30. This tends to insure that the extent of displacement of the control plunger 14 and the metered fuel quantities are proportionate to one another.

Upon a pivotal motion of the lever 11, the air sensor 2 is moved in the conical portion 3 of the suction pipe 1 and, as a result, the annular flow passage section between the air sensor and the conical portion changes in proportion to the excursion of the air sensor 2.

Fuel is used as the pressurized liquid for exerting a restoring force on the control plunger 14. For this purpose, from the fuel supply conduit 21 there extends a conduit 36 which is separated from a control pressure conduit 38 by an uncoupling throttle 37. The control pressure conduit 38 is connected via a damping throttle 39 with a pressure chamber 40, into which projects the front face 15 of the control plunger 14.

In the control pressure conduit 38 there is disposed an electromagnetic valve 42 which comprises a flat seat valve, with a stationary valve seat 45 which also serves as the core of the electromagnetic valve 42, and a diaphragm 43 which serves both as the movable valve member, and as the armature of the electromagnetic valve 42. When the electromagnetic valve is de-energized, a counterspring 44 acts on the diaphragm 43 to close the valve. When sufficient voltage is applied to the coil 49 at the electromagnetic valve, the diaphragm 43 moves away from the stationary valve seat 43 to open the valve. The fuel flowing between the stationary valve seat 45 and the diaphragm 43 when the electromagnetic valve is open, can flow back to the fuel tank 20 via a return flow conduit 48.

A control current is supplied to the coil 49 of the electromagnetic valve 42 by a plug 50, which is electrically connected to an electronic control device 52 by a control line 51. The measurements of the operating parameters converted into voltages are supplied to this electronic control device 52. The electronic control device 52 is electrically connected by a line 53 with a temperature gauging transmitter 57 which, for example, may contain a temperature-dependent resistance, and by a line 54, with an exhaust gas measuring probe 55 which is disposed in the exhaust gas line 56 of the internal combustion engine.

Construction of the exhaust gas measuring probe 55, temperature gauging transmitter 57, signal generator 58 and electronic control device 52 are known, for example, from U.S. Pat. Nos. 2,943,614, 3,620,196, 3,716,034, 3,745,768, 3,782,347, 3,827,237, 3,828,749, 3,831,564, and allowed U.S. patent application Ser. No. 259 157, now U.S. Pat. No. 3,874,171.

Figure 2:
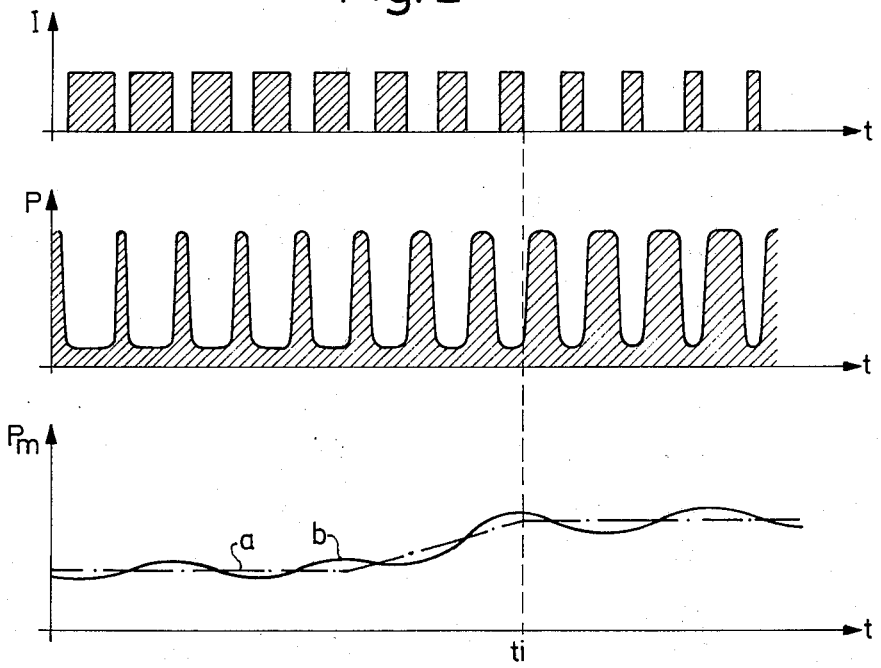
FIG. 2 is a diagram showing the chronological course of the valve excitation current, the control pressure and the average control pressure.

The method of operation of the fuel injection system is as follows:

When the internal combustion engine is running, fuel is drawn from the tank 20 by the pump 19 driven by the electric motor 18 and is forced through the fuel supply conduit 21 to the metering and distributor valve 10. At the same time the internal combustion engine draws air through the suction pipe 1 and, as a result, the air sensor 2 undergoes a certain excursion from its rest position. In response to the deflection of the air sensor 2, the control plunger 14 is displaced by the lever 11, thus causing the overlap of the annular groove 27 and the control slots 30 to be increased. The direct connection between the air sensor 2 and the control plunger 14 insures a constant ratio between the air quantities and the metered quantities of fuel, provided the characteristics of these two components are sufficiently linear (which is desideratum by itself). In such a case, the air-fuel ratio would then be constant for the entire operational range of the engine. However, it is a requirement that the air-fuel mixture be richer or leaner, depending on the operating conditions of the internal combustion engine. The requirement is achieved by altering the restoring force on the air sensor 2. For this purpose, the electromagnetic valve 42 is disposed in the control pressure conduit 38. The electromagnetic valve 42 is controlled during the warm-up stage of the internal combustion engine by a temperature gauging transmitter 57 via the electronic control device 52. Upon termination of the warm-up stage, the electromagnetic valve 42 is controlled by the exhaust gas measuring probe 55 which is disposed in the exhaust gas line 56. The exhaust gas measuring probe 55 supplies a voltage which is dependent on the oxygen content in the exhaust gas of the internal combustion engine. If the probe voltage exceeds a specific threshold value, the electronic control device 52 does not supply any control current I (FIG. 2). As a result, the electromagnetic valve 42 is closed and the control pressure rises to the value of the pressure in the system which is synonymous with the exertion of a powerful return force on the air sensor 2. This operational state is characterized by an over-rich fuel-air mixture. If the probe voltage now drops below the threshold value, the electronic control device 52 supplies a control current I and the electromagnetic valve 42 is opened. The control pressure can now drop to a pressure which is characterized by the force of the counterspring 44, whereupon the return force exerted on the air sensor 2 is reduced. This operational state is characterized by too lean a fuel-air mixture. In FIG. 2 there is represented the course of the control current I, of the control pressure p and the average control pressure $p_m$ over the period $t$. After a specific period of time $t_i$ the warm-up stage is terminated and the control of the electromagnetic valve is effected solely by the exhaust gas measuring probe.

The specific period of time $t_i$ is dependent on the start-temperature of the internal combustion engine.

The dot-dash line $a$ represents the course of the nominal value of the average conrol pressure $p_m$ and the solid line $b$ the actual course of the average control pressure $p_m$ which fluctuates about the nominal value $a$.

The electromagnetic valve 42 is advantageously operated with constant frequency and with the open or closed time of each operating cycle controlled by the operating parameters of the internal combustion engine.

According to another embodiment of the invention the electromagnetic valve 42 is controlled with a constant open or closed time per cycle, and with a frequency of operation which varies in dependence on the operating parameters. This type of control of the electromagnetic valve offers the advantage that the electronic control device 52 can be of substantially simpler design and is thus less costly to produce.

According to another embodiment of the invention, the electromagnetic valve 42 is operated at a frequency of the engine delivered from a signal generator 58 (gas changing frequency) or a multiple of the engine frequency, and its open or closed time per operating cycle is variable in dependence on the operating parameters of the internal combustion engine. The engine or gas changing frequency can be sensed relatively easily, for example, by means of the ignition pulses at the ignition contacts. This embodiment offers the advantage of automatic adaptation of the regulating frequency to the engine idling periods determined by the gas changing process in combination with the operating parameters.

According to an embodiment a throttle 59 is disposed downstream of the electromagnetic valve. This throttle is provided to determine the lower limit of the control pressure.

Figure 3:
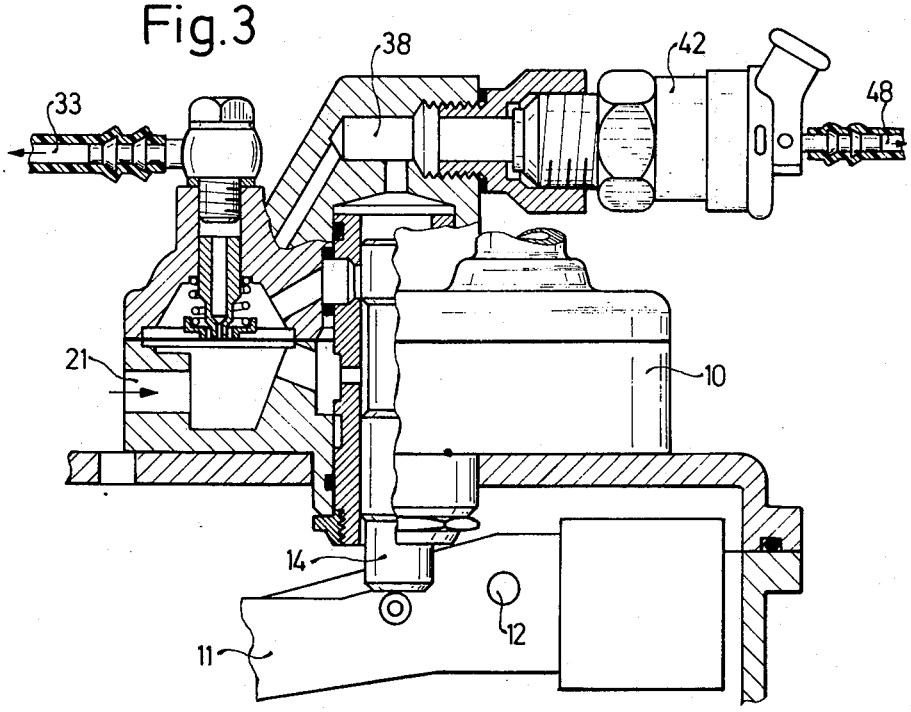
FIG. 3 shows an electromagnetic valve mounted on the distributor housing.

As represented in FIG. 3, the electromagnetic valve 42 can also be advantageously mounted on the metering and distributor valve housing 10 in the manner of a prefabricated machine part.

What is claimed is:

1. In a fuel injection system for use with a spark plug-ignited, internal combustion engine, the fuel injection system having:

a suction tube for air intake to the engine, an air sensor disposed in said suction tube, an arbitrarily operable butterfly valve disposed is said suction tube in series with said air sensor, a fuel supply conduit, a control pressure conduit, an uncoupling throttle disposed between said fuel supply conduit and said control pressure conduit, a fuel metering valve connected to said fuel supply conduit and said control pressure conduit for continuously injecting fuel into said suction tube, a control plunger, serving as the movable member of said fuel metering valve, said control plunger being acted upon on one end by said air sensor, and on an opposite end by a return force provided by liquid under pressure delivered by said control pressure conduit, for metering a fuel quantity that is proportionate to the quantity of air measured by said air sensor, and at least one electromagnetic valve disposed in said control pressure conduit for varying pressure in said control pressure conduit in dependence on at least one operating parameter of the engine, the improvement in the fuel injection system which comprises, in combination:

a. a temperature gauging transmitter which senses and converts an engine temperature into a proportionate electrical voltage output;

b. means for sensing and converting an engine operating parameter other than temperature into a proportionate electrical voltage output; and c. an electronic control device, electrically connected to an operating coil of the electromagnetic valve and the outputs of the temperature gauging transmitter and the means for sensing and converting an engine operating parameter other than temperature, which comprises a switching means which allows the electronic control device to actuate the electromagnetic valve proportionate to the voltage output of the temperature gauging transmitter during the engine warmup, and then switch to activate the electromagnetic valve proportionate to the voltage output of the means for sensing and converting an engine operating parameter other than temperature.

2. An improvement as defined in claim 1, wherein the means for sensing and converting an engine operating parameter into an electrical voltage output is an exhaust gas measuring probe which senses the oxygen content of the engine exhaust gas.

3. An improvement as defined in claim 1, wherein the electronic control device actuates the electromagnetic valve with a constant frequency of operation and a variable open time.

4. An improvement as defined in claim 1, wherein the electronic control device actuates the electromagnetic valve with a constant open time and variable frequency.

5. An improvement as defined in claim 1, wherein the electronic control device actuates the electromagnetic valve by the ignition pulses at the engine frequency and with a variable open time.

6. An improvement as defined in claim 1, wherein the electronic control device actuates the electromagnetic valve by the ignition pulses at a multiple of the engine frequency and with a variable open time.

7. An improvement as defined in claim 1, wherein the electromagnetic valve is preferably open in the excited state and comprises a flat seat valve with a diaphragm as the movable valve member which simultaneously serves as an armature, and is acted on by a counterspring in the closing direction.

8. An improvement as defined in claim 7, wherein the upper limit of the control pressure in the control pressure line is determined by the pressure in the system and the lower limit by the force of the counterspring.

9. An improvement as defined in claim 1, wherein a throttle is disposed in the control pressure conduit downstream of the electromagnetic valve.

10. An improvement as defined in claim 9, wherein the upper limit of the control pressure is determined by the pressure in the system and the lower limit by the throttle.

11. An improvement as defined in claim 1, wherein the electromagnetic valve is mounted on the metering and distributor housing in the manner of a prefabricated machine part.

* * * * *